United States Patent [19]

Yokoe et al.

[11] Patent Number: 4,602,578

[45] Date of Patent: Jul. 29, 1986

[54] WORKPIECE FEED DEVICE IN SEWING MACHINE

[75] Inventors: Masaaki Yokoe; Humio Nakanishi; Yoshiyuki Ohtsuka, all of Aichi, Japan

[73] Assignee: Brother Kogyo Kabushiki Kaisha, Nagoya, Japan

[21] Appl. No.: 777,507

[22] Filed: Sep. 19, 1985

[30] Foreign Application Priority Data

Sep. 20, 1984 [JP] Japan ..... 59-197264

[51] Int. Cl.[4] ..... D05B 21/00

[52] U.S. Cl. ..... 112/121.15; 112/121.12

[58] Field of Search ..... 112/121.15, 121.12, 112/121.11, 307, 308

[56] References Cited

U.S. PATENT DOCUMENTS

| | | | |
|---|---|---|---|
| 3,450,076 | 6/1969 | Bender | 112/121.12 X |
| 4,072,114 | 2/1978 | Sugiyama | 112/121.12 |
| 4,171,671 | 10/1979 | Welcher et al. | 112/121.12 |
| 4,312,282 | 1/1982 | Dorosz et al. | 112/121.12 |
| 4,406,234 | 9/1983 | Johnson et al. . | |
| 4,433,632 | 2/1984 | Becka et al. | 112/121.12 X |
| 4,501,207 | 2/1985 | Miyhzakai et al. | 112/121.15 X |
| 4,510,875 | 4/1985 | Peck | 112/121.12 |

FOREIGN PATENT DOCUMENTS

| | | | |
|---|---|---|---|
| 1329309 | 4/1963 | France | 112/121.15 |

*Primary Examiner*—Ronald Feldbaum

*Attorney, Agent, or Firm*—Finnegan, Henderson, Farabow, Garrett & Dunner

[57] ABSTRACT

A device for positioning a workpiece relative to the needle of a sewing machine is shown. The workpiece is mounted on a pallet which is moved in the Y-direction by actuating a motor to move a movable frame upon which a carriage with the attached pallet is mounted. The workpiece is moved in the X-direction by actuating another motor to move the carriage with the attached pallet along the movable frame.

3 Claims, 3 Drawing Figures

WORKPIECE FEED DEVICE IN SEWING MACHINE

BACKGROUND OF THE INVENTION

1. Field of the Invention

This invention relates to a device for positioning a workpiece relative to the needle of a sewing machine.

2. Description of the Related Art

Automated machinery requires the accurate positioning of a workpiece, relative to the operative machine, for movement according to predetermined operational programs. In a computer-controlled sewing machine, the workpiece must be automatically positioned relative to the needle of the sewing machine.

Devices for automatically positioning a workpiece relative to a sewing machine needle are known. One such device is illustrated in U.S. Pat. No. 4,406,234 issued to Johnson et al.

When existing devices for carrying and automatically moving a workpiece relative to a sewing machine are positioned to one side, the existing devices may be subjected to torsion and rattling. It is an object of the present invention to provide a workpiece feed device which may be moved without torsion or rattling, even when the load on the device is positioned to one side.

SUMMARY OF THE INVENTION

In order to achieve the above object, the present invention provides a workpiece feed device for a sewing machine. The sewing machine includes a machine bed. On the machine bed are mounted stationary racks which mesh with support gears. A movable frame is rotatably mounted on a support shaft which connects the support gears. A carriage is secured to and movable along the top of the movable frame. A platform is removably connected to the carriage and a workpiece may be attached to the platform. The workpiece, so attached, may be positioned relative to the sewing machine needle according to a predetermined sewing program. A first motor moves the movable frame and platform in the Y-axis direction while a second motor moves the carriage and platform in the X-axis direction.

DESCRIPTION OF THE PREFERRED EMBODIMENT

Figure 2:
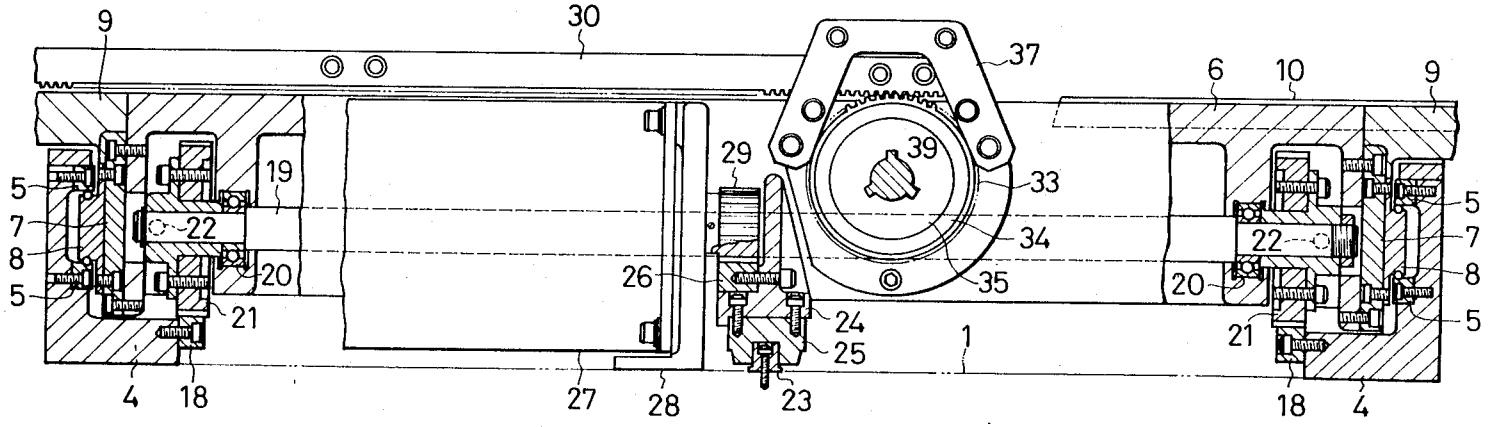
FIG. 2 is an enlarged front cross-sectional view of the embodiment shown in FIG. 1.
Figure 3:
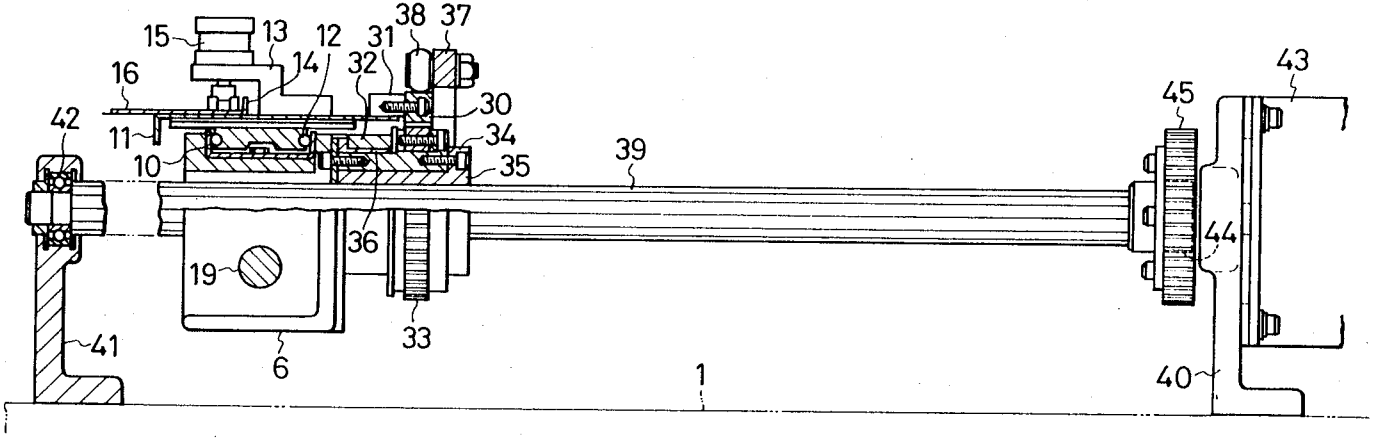
FIG. 3 is an enlarged side view of the embodiment shown in FIG. 1.

With reference to the accompanying drawings, the present invention will be explained in detail. In the sewing machine of this embodiment (shown in FIG. 1), a machine body 2 is mounted on a machine bed 1 and a needle 3, arranged at the front end of the machine body 2, cooperates with a loop taker (not shown) so as to constitute a stich forming instrument. Support members 4, having an L-like form (as shown in FIG. 2), are secured on the machine bed 1 at both the left and right sides of the front of the machine body 2. Upper and lower rails 5 are attached to the inner side surfaces of each of the support members 4 so that the guide rails 5 extend parallel to each other in a longitudinal direction (Y-axis direction). A movable frame 6 is supported between the opposite left and right guide rails 5 by means of attaching plates 7 and rail slide members 8 so that the frame 6 is movable in the Y-axis direction. Auxiliary frames 9 are attached to both the left and right ends of the movable frame 6 while a guide member 10 having a U-like shape (as shown in FIG. 3) is set on and secured to the upper surfaces of the frame 56 and 9. The guide member 10 extends in the lateral direction (X-axis direction).

Figure 1:
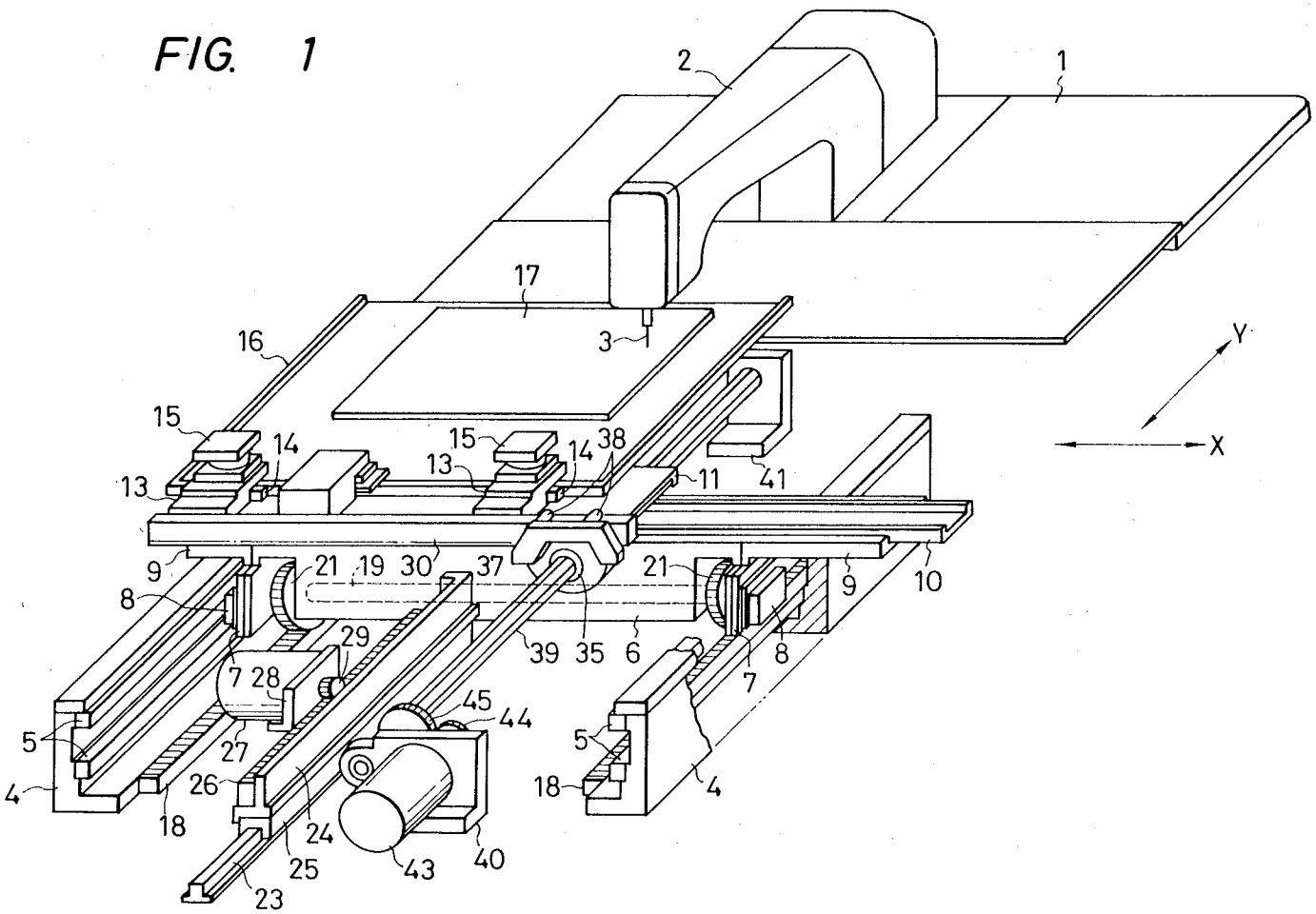
FIG. 1 is a perspective view illustrating one embodiment of the present invention.

As shown in FIGS. 1 and 3, a carriage 11 is supported on the guide member 10 on the frame 6 by means of a ball slide member 12 so that the carriage 11 is movable in the X-axis direction. A pair of clamp members 13 are arranged at the front edge of the upper surface of the carriage 11. Positioning projections 14 project from the rear of the clamp members 13 and clamping air cylinders 15 are arranged on top of the clamp members 13. A pallet 16, having a needle groove (not shown) corresponding to a sewing pattern, is removably connected to the upper surface of the carriage 11. The pallet 16 is engaged at a predetermined position by the positioning projections 14 of the clamp member 13, and it is secured by means of the air cylinders 15. A workpiece 17 is removably clamped and held on the upper surface of the pallet 16 by means of a holding frame (not shown). The workpiece 17 may be set at a predetermined position with respect to the needle 3 by moving the carriage 11 in the X-axis direction and by moving the movable frame 6 in the Y-axis direction.

The drive arrangement for the movable frame 6 and the carriage 11 will be explained with reference to FIGS. 1 and 2. A pair of stationary racks 18, each having teeth on its upper surface, are secured to the insides of the lower ends of both support members 4 below the ends of the movable frame 6. The racks 18 extend lengthwise in the Y-axis direction orthogonal to the moving direction of the carriage 11. A support shaft 19 is rotatably connected to the movable frame 6 by means of bearing 20 such that the support shaft 19 extends in the X-axis direction above the stationary racks 18. The support shaft 19 has a pair of support gears 21 secured to both of its ends by means of set screws 22. The support gears 21 mesh with the stationary racks 18 of the same meshing phase. Further, upon movement of the movable frame 6 in the Y-axis direction, the pair of support gears 21 are rotated along the stationary racks 18 in synchronism with each other because they are connected by support shaft 19; torsion and rattling or thereby inhibited in the laterally extending long movable frame 6.

As shown in FIGS. 1 and 2, a support rail 23, extending lengthwise parallel to the stationary racks 18 (the Y-axis direction), is secured to the machine bed 1 substantailly midway between the support members 4. A support member 24, supported on the support rail 23 by means of a slide rail 25, is movable in the Y-axis direction. Support member 24 is secured at its rear end to the front surface of the movable frame 6 substantially at the middle section of the latter and a first drive rack 26 is attached parallel to the upper surface of the support member 24. To the side of the support rail 23, a first motor 27 is mounted on the machine bed 1 by way of a support member 28. The motor shaft is secured to a motor gear 29 which meshes with the first drive rack 26. When the first motor 27 is rotated in accordance with a predetermined program corresponding to a predetermined pattern, the movable frame 6 is moved in the Y-axis direction via the gear motor 29 and the first drive rack 26.

As shown in FIGS. 1–3, a second drive rack 30 having teeth on its lower surface is attached to the front edge of the carriage 11 by an attaching plate 31, extending lengthwise in the movement direction of the carriage 11 (the X-axis direction). An attaching member 32 is secured to and projected from the front edge of the center section of the movable frame 6. The attaching member 32 extends below the second drive rack 30, and its lower section is attached by means of a bearing 36. The second drive rack 30 meshes with a carriage gear 33, a bushing 34 and the spline bearing 35 which are all secured together so as to be integrally rotatable. A pair of rollers 38 are rotatably connected to the rear surface of the upper part of a support plate 37 which is attached to the front end of the attaching member 32. The rollers 38 are positioned to contact the upper surface of the second drive rack 30 thus preventing the rack 30 from coming off the carriage gear 33.

A splined shaft 39 is rotatably connected to the machine bed 1 by means of a pair of front and rear support members 40 and 41, respectively, each with bearings 42, such that the splined shaft extends parallel to the first drive rack 26 (the Y-axis direction) on the lateral side of the rack 26. The splined shaft 39 is fitted through the center of the carriage gear 33 by means of the spline bearing 35 such that the splined shaft 39 rotates integrally with the carriage gear 33 but slides relative thereto in the shaft's axial direction (the Y-axis direction). A second motor 43 with a motor gear 44 secured to its shaft is attached to the outer surface of the front support member 40. The second motor 43 rotates the splined shaft 39 when the motor gear 44 meshes with a shaft gear 45 secured to the front end of the splined shaft 39. In this embodiment, when the second motor 43 is rotated in accordance with the predetermined program corresponding to the predetermined sewing pattern, the splined shaft 39 rotates so that the carriage 11 is moved a predetermined distance in the X-axis direction via the carriage gear 33 and the second drive rack 30.

In this sewing machine embodiment, when drive signals are delivered to the first and second motors 27 and 43, respectively, in accordance with the predetermined sewing program corresponding to the predetermined sewing pattern, the motors are respectively rotated. When the first motor 27 rotates, the movable frame 6 is moved in the Y-axis direction via the gear 29 and the first drive rack 26, while the second motor 43 simultaneously rotates the splined shaft 39 via the gears 44 and 45 so that the carriage 11 is moved in the X-axis direction via the carriage gear 33 and the second drive rack 30.

With the movement of the movable frame 6 in the Y-axis direction, the pair of the support gears 21 synchronizedly rotate by means of the support shaft 19 as the support gears 21 mesh with the stationary racks 18, and the carriage gear 33 on the splined shaft 39 slides in the Y-axis direction along the splined shaft 39. Accordingly, even if the carriage 11 carrying the pallet 16 is set toward one side of the movable frame 6 such that one of the support gears 21 carries a greater load than the other one of the support gears 21, the movable frame 6 is still smoothly moved with no torsion or rattling. Therefore, a workpiece 17 on the pallet 16 may be rapidly and precisely positioned with respect to the needle 3, so that a sewing seam is formed on the workpiece 17 when the needle 3 cooperates with the shuttle race body (not shown). Therefore, the length of the movable frame in the X-axis direction can be increased so that the moving stroke of the carriage 11 can be made large even though the load may be unevenly distributed as described above.

The present invention is not limited to the arrangement of this embodiment, and the structure and the arrangement may be changed without departing from the scope of the present invention as defined by its appended claims and their equivalents.

What is claimed is:

1. A workpiece feed device for a sewing machine comprising:

a machine bed;

a pair of stationary racks mounted parallel to one another on said machine bed, each stationary rack having teeth on its upper surface;

a plurality of support gears disposed to mesh with said stationary racks;

a support shaft axially connecting said gears;

a movable frame rotatably connected to said support shaft;

a carriage movably supported to the top of said movable frame, said carriage being movable in a direction orthogonal to the direction of movement of said movable frame;

a pallet removably connected to said carriage, said pallet being adapted to hold the workpiece in a predetermined position with respect to the sewing machine; and first and second motors, said first motor being adapted to move said movable frame along with said first pair of stationary racks, and said second motor being adapted to move said carriage.

2. A workpiece feed device as recited in claim 1, further comprising:

a first drive rack secured to the lower part of said movable frame, said drive rack having teeth on its upper surface, and said first drive rack extending substantially parallel to said stationary racks;

a motor gear engaged with said first drive rack and rotating to move said first drive rack and movable frame, said first motor gear being driven by said first motor.

3. A workpiece feed device as recited in claim 1 or 2, further comprising:

a second drive rack, having teeth on its lower surface, said second drive rack being connected to said carriage and extending orthogonal to said stationary racks;

a carriage gear rotatably mounted on said movable frame;

a splined shaft, driven by said second motor, said shaft being fitted through the center of said carriage gear, said shaft being integrally rotatable with said carriage gear, while also being axially slidable relative to said carriage gear.

* * * * *